US011751628B2

(12) United States Patent
Troufanov et al.

(10) Patent No.: US 11,751,628 B2
(45) **Date of Patent: *Sep. 12, 2023**

(54) ARTICLE OF FOOTWEAR WITH ZONAL CUSHIONING SYSTEM

(71) Applicant: NIKE, Inc., Beaverton, OR (US)

(72) Inventors: Nikita Troufanov, Portland, OR (US); Rosa Kim, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/714,243

(22) Filed: Apr. 6, 2022

(65) Prior Publication Data

US 2022/0279896 A1 Sep. 8, 2022

Related U.S. Application Data

(63) Continuation of application No. 16/825,746, filed on Mar. 20, 2020, now Pat. No. 11,311,076.

(60) Provisional application No. 62/822,322, filed on Mar. 22, 2019.

(51) Int. Cl.

| | |
|---|---|
| ***A43B 13/18*** | (2006.01) |
| ***A43B 13/14*** | (2006.01) |
| ***A43B 13/20*** | (2006.01) |
| ***A43B 13/04*** | (2006.01) |

(52) U.S. Cl.

CPC ..... *A43B 13/188* (2013.01); *A43B 13/141* (2013.01); *A43B 13/186* (2013.01); *A43B 13/20* (2013.01); *A43B 13/04* (2013.01); *A43B 13/183* (2013.01)

(58) Field of Classification Search

None

See application file for complete search history.

(56) References Cited

U.S. PATENT DOCUMENTS

| | | | | | |
|---|---|---|---|---|---|
| 1,870,114 | A * | 8/1932 | Heller | A43B 13/182 | 36/3 R |
| 2,437,227 | A * | 3/1948 | Hall | A43B 13/182 | 36/28 |
| 2,721,400 | A * | 10/1955 | Israel | A43B 13/182 | 36/169 |
| 4,439,936 | A * | 4/1984 | Clarke | A43B 13/26 | 36/102 |
| 4,918,838 | A * | 4/1990 | Chang | A43B 13/203 | 36/28 |

(Continued)

*Primary Examiner* — Heather Mangine
*Assistant Examiner* — Raquel M. Weis
(74) *Attorney, Agent, or Firm* — Quinn IP Law

(57) ABSTRACT

An article of footwear includes an upper and a sole structure secured to an underside of the upper. The sole structure includes a midsole; a ground contacting outsole surface; and a cushioning system disposed between the midsole and the ground contacting outsole surface. The cushioning system includes a plate comprising an upper plate and a lower plate provided in a spaced relationship. The upper plate and lower plate are integrally connected at a posterior portion of the sole structure. The sole structure further including at least one of a midfoot fluid-filled chamber provided between the upper plate and the lower plate within the midfoot region, or a forefoot fluid-filled chamber is provided between the upper plate and the lower plate within the forefoot region.

13 Claims, 7 Drawing Sheets

(56) References Cited

U.S. PATENT DOCUMENTS 5,003,709 A * 4/1991 Okayasu ..... A43B 17/04 36/73
5,138,776 A * 8/1992 Levin ..... A63B 25/10 36/38
5,343,639 A * 9/1994 Kilgore ..... A43B 13/183 36/35 B
D382,690 S * 8/1997 Hirahata ..... D2/902
5,901,467 A * 5/1999 Peterson ..... A43B 13/20 36/35 B
6,115,943 A * 9/2000 Gyr ..... A43B 21/26 36/35 R
6,385,864 B1 * 5/2002 Sell, Jr. ..... A43B 13/20 36/35 B
6,453,577 B1 * 9/2002 Litchfield ..... A43B 13/203 36/35 B
6,487,796 B1 * 12/2002 Avar ..... A43B 13/182 36/114
6,851,204 B2 * 2/2005 Aveni ..... A43B 13/189 36/114
6,898,870 B1 * 5/2005 Rohde ..... A43B 13/181 36/3 R
6,925,732 B1 * 8/2005 Clarke ..... A43B 7/141 36/31
6,964,120 B2 * 11/2005 Cartier ..... A43B 13/12 36/35 B
7,082,703 B2 * 8/2006 Greene ..... A43B 7/26 36/94
7,334,351 B2 * 2/2008 Hann ..... A43B 13/16 36/102
7,360,324 B2 * 4/2008 Aveni ..... A43B 13/186 36/35 R
7,437,838 B2 * 10/2008 Nau ..... A43B 13/16 36/94
7,458,172 B2 * 12/2008 Aveni ..... F16F 3/023 36/137
7,493,708 B2 * 2/2009 Crowley, Jr. ..... A43B 13/183 36/103
7,513,065 B2 * 4/2009 Kita ..... A43C 15/168 36/27
7,546,695 B2 * 6/2009 Aveni ..... A43B 13/181 36/114
7,624,515 B2 * 12/2009 Kita ..... A43B 13/146 36/27
7,673,397 B2 * 3/2010 Jarvis ..... A43B 13/226 36/35 R
7,707,747 B2 * 5/2010 Nawachi ..... A43B 7/26 36/94
7,748,142 B2 * 7/2010 Fusco ..... A43C 15/168 36/27
7,757,410 B2 * 7/2010 Aveni ..... A43B 13/181 36/35 R
7,779,558 B2 * 8/2010 Nishiwaki ..... A43B 13/189 36/27
7,886,461 B2 * 2/2011 Sato ..... A43B 13/183 36/27
7,971,374 B2 * 7/2011 Hernandez ..... A43B 5/06 36/94
7,979,936 B2 * 7/2011 Aveni ..... A43B 21/26 12/146 B
7,980,006 B2 * 7/2011 Aveni ..... A43B 21/36 36/114
7,997,011 B2 * 8/2011 Smith ..... A43B 21/26 36/114
8,181,360 B2 * 5/2012 Kita ..... A43B 13/181 36/28
D682,514 S * 5/2013 Lamstein ..... D2/908
8,510,970 B2 * 8/2013 Baum ..... A43B 13/183 36/7.8
8,943,709 B2 * 2/2015 Aveni ..... A43B 21/28 36/35 B
8,991,075 B2 * 3/2015 Chenciner ..... A43B 3/0036 36/8.1
9,320,313 B2 * 4/2016 Craig ..... A43B 13/141
9,332,805 B2 * 5/2016 Baum ..... A43B 13/37
9,668,540 B2 * 6/2017 Scofield ..... A43B 13/181
9,687,042 B2 * 6/2017 Berend ..... A43B 7/144
9,750,300 B2 * 9/2017 Peyton ..... A43B 7/32
9,750,307 B2 * 9/2017 Campos, II ..... A43B 13/22
9,936,765 B2 * 4/2018 Sato ..... A43B 13/186
9,968,160 B2 * 5/2018 Peyton ..... A43B 13/183
10,231,506 B2 * 3/2019 Chenciner ..... A43B 13/14
10,750,821 B2 * 8/2020 Greene ..... A43B 13/223
11,000,093 B2 * 5/2021 Connell ..... A43B 13/184
11,311,076 B2 * 4/2022 Troufanov ..... A43B 13/189
2001/0042321 A1 * 11/2001 Tawney ..... A43B 13/20 36/43
2003/0000109 A1 * 1/2003 Kita ..... A43B 13/188 36/31
2004/0221483 A1 * 11/2004 Cartier ..... A43B 13/181 36/27
2004/0261292 A1 * 12/2004 Aveni ..... A43B 13/181 36/114
2005/0000115 A1 * 1/2005 Kimura ..... A43B 13/026 36/142
2005/0108897 A1 * 5/2005 Aveni ..... A43B 13/187 36/27
2005/0166427 A1 * 8/2005 Greene ..... A43B 7/26 36/94
2005/0252038 A1 * 11/2005 Braunschweiler ... A43B 13/184 36/28
2005/0268490 A1 * 12/2005 Foxen ..... A43B 13/189 36/28
2005/0283999 A1 * 12/2005 Whatley ..... A43B 13/127 36/29
2006/0010715 A1 * 1/2006 Tseng ..... A43B 13/12 36/27
2006/0137227 A1 * 6/2006 Kita ..... A43B 13/181 36/102
2006/0185191 A1 * 8/2006 Crowley ..... A43B 13/181 36/103
2006/0248749 A1 * 11/2006 Ellis ..... A43B 13/203 36/28
2006/0265902 A1 * 11/2006 Kita ..... A43B 13/141 36/12
2007/0033830 A1 * 2/2007 Chang ..... A43B 3/0052 36/28
2007/0033831 A1 * 2/2007 Aveni ..... A43B 21/26 36/27
2007/0101617 A1 * 5/2007 Brewer ..... A43B 7/08 36/103
2007/0266593 A1 * 11/2007 Schindler ..... A43B 13/181 36/28
2007/0277395 A1 * 12/2007 Aveni ..... A43B 13/18 36/35 B
2008/0016720 A1 * 1/2008 Aveni ..... A43B 21/26 36/28
2008/0078101 A1 * 4/2008 Smith ..... A43B 21/26 36/103
2008/0115386 A1 * 5/2008 Geuss ..... A43B 7/26 36/94
2008/0216360 A1 * 9/2008 Schenone ..... A43B 13/14 36/30 R
2008/0256827 A1 * 10/2008 Hardy ..... A43B 21/265 36/35 B
2008/0263893 A1 * 10/2008 Hernandez ..... A43B 7/26 36/1
2009/0056165 A1 * 3/2009 Lee ..... A43B 13/12 36/108
2009/0100705 A1 * 4/2009 Cook ..... A43B 13/026 36/28
2009/0126224 A1 * 5/2009 Greene ..... A43B 13/186 36/35 R
2009/0133288 A1 * 5/2009 Gallegos ..... A43B 7/223 36/71
2009/0172971 A1 * 7/2009 Peikert ..... A43B 13/12 12/146 B
2009/0178303 A1 * 7/2009 Hurd ..... A43B 13/026 36/107

(56) References Cited

U.S. PATENT DOCUMENTS

2009/0241373 A1* 10/2009 Kita ..... A43B 13/143 36/44
2010/0107444 A1* 5/2010 Aveni ..... A43B 13/189 36/35 B
2010/0269368 A1* 10/2010 Nakatsuka ..... A43B 5/06 36/27
2011/0131831 A1* 6/2011 Peyton ..... A43B 21/28 36/47
2011/0203133 A1* 8/2011 Peyton ..... A43B 3/0057 428/34.1
2011/0239489 A1* 10/2011 Iuchi ..... A43B 13/141 36/25 R
2012/0246969 A1* 10/2012 Baum ..... A43B 13/181 36/27
2013/0160324 A1* 6/2013 Peyton ..... A43B 7/32 36/83
2013/0167401 A1* 7/2013 Christensen ..... A43B 13/20 36/29
2014/0059883 A1* 3/2014 Adeagbo ..... A43B 13/187 36/28
2014/0068966 A1* 3/2014 Chaffin ..... A43B 13/183 36/28
2014/0075777 A1* 3/2014 Bruce ..... A43B 7/148 36/29
2014/0075778 A1* 3/2014 Bruce ..... A43B 13/10 36/29
2014/0075779 A1* 3/2014 Bruce ..... A43B 7/148 36/29
2014/0259747 A1* 9/2014 Baudouin ..... A43B 13/141 36/28
2014/0290098 A1* 10/2014 Loverin ..... A43B 13/37 36/27
2015/0013185 A1* 1/2015 Elder ..... A43B 13/122 36/83
2015/0040432 A1* 2/2015 Berend ..... A43B 13/20 36/102
2015/0040435 A1* 2/2015 Barnes ..... A43B 13/186 36/102
2015/0272271 A1* 10/2015 Campos, II ..... A43B 13/16 36/29
2016/0058123 A1* 3/2016 Peyton ..... A43B 13/141 36/25 R
2016/0058124 A1* 3/2016 Lucas ..... A43B 7/144 36/28
2016/0338446 A1* 11/2016 Merlo ..... A43B 13/36
2017/0042286 A1* 2/2017 Meschter ..... A43B 13/04
2017/0280816 A1* 10/2017 Lyden ..... A43B 3/128
2017/0280823 A1* 10/2017 Langvin ..... A43B 9/02
2018/0192734 A1* 7/2018 Möhlmann ..... A43B 7/082
2018/0213886 A1* 8/2018 Connell ..... A43B 13/125
2020/0297071 A1* 9/2020 Troufanov ..... A43B 13/127

* cited by examiner

ARTICLE OF FOOTWEAR WITH ZONAL CUSHIONING SYSTEM

CROSS REFERENCE TO RELATED APPLICATIONS

The present application is a continuation of U.S. Ser. No. 16/825,746, filed on 20 Mar. 2020 and published as US 2020/0297071, which claims the benefit of priority from U.S. Provisional Patent Application No. 62/822,322, filed 22 Mar. 2019, each of which is incorporated by reference in its entirety.

TECHNICAL FIELD

The present disclosure relates to an article of footwear and more particularly to a sole structure for an article of footwear.

BACKGROUND

Conventional articles of athletic footwear include two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and is generally positioned between the foot and the ground. In addition to attenuating ground reaction forces and absorbing energy (i.e., imparting cushioning), the sole structure may provide traction and control potentially harmful foot motion, such as over pronation. Accordingly, the upper and the sole structure operate cooperatively to provide a comfortable structure that is suited for a wide variety of ambulatory activities, such as walking and running.

The sole structure generally incorporates multiple layers that are conventionally referred to as an insole, a midsole, and an outsole. The insole is a thin, cushioning member located within the upper and adjacent the plantar (lower) surface of the foot to enhance footwear comfort. The midsole, which is traditionally attached to the upper along the entire length of the upper, forms the middle layer of the sole structure and serves a variety of purposes that include controlling foot motions and providing cushioning. The outsole forms the ground-contacting element of footwear and is usually fashioned from a durable, wear-resistant material that includes texturing to improve traction.

The primary element of a conventional midsole is a resilient, polymer foam material, such as polyurethane or ethylvinylacetate, that extends throughout the length of the footwear. The properties of the polymer foam material in the midsole are primarily dependent upon factors that include the dimensional configuration of the midsole and the specific characteristics of the material selected for the polymer foam, including the density of the polymer foam material. By varying these factors throughout the midsole, the relative stiffness, degree of ground reaction force attenuation, and energy absorption properties may be altered to meet the specific demands of the activity for which the footwear is intended to be used.

SUMMARY

A sole structure for an article of footwear includes a midsole formed of a foamed polymer, a ground contacting outsole surface, and a cushioning system disposed between the midsole and the ground contacting outsole surface. The cushioning system includes a polymeric plate defining an upper plate and a lower plate provided in a spaced relationship. The upper plate and lower plate are integrally connected at a posterior portion of the sole structure. At least two vertically stacked fluid-filled chambers are provided between the upper plate and the lower plate within the midfoot region of the cushioning system. The at least two vertically stacked fluid-filled chambers include a first midfoot fluid-filled chamber coupled to the upper plate, and a second midfoot fluid-filled chamber coupled to and between the first midfoot fluid-filled chamber and the lower plate.

The cushioning system further includes at least two laterally arranged fluid-filled chambers provided between the upper plate and the lower plate within the midfoot region of the cushioning system. The at least two laterally arranged fluid-filled chambers include a lateral forefoot fluid-filled chamber and a medial forefoot fluid-filled chamber. The lateral forefoot fluid-filled chamber is positioned between a lateral edge of the sole structure and the medial forefoot fluid-filled chamber, and the medial forefoot fluid-filled chamber is positioned between a medial edge of the sole structure and the lateral forefoot fluid-filled chamber.

DETAILED DESCRIPTION

The following discussion and accompanying figures disclose an article of footwear 10 (also referred to as the article 10) in accordance with the present invention. The article 10 is depicted in the figures and discussed below as having a configuration that is suitable for athletic activities, particularly running. The concepts disclosed with respect to the article 10 may, however, be applied to footwear styles that are specifically designed for a wide range of other athletic activities, including basketball, baseball, football, soccer, walking, and hiking, for example, and may also be applied to various non-athletic footwear styles. Accordingly, one skilled in the relevant art will recognize that the concepts disclosed herein may be applied to a wide range of footwear styles and are not limited to the specific embodiments discussed below and depicted in the figures.

Figure 1:
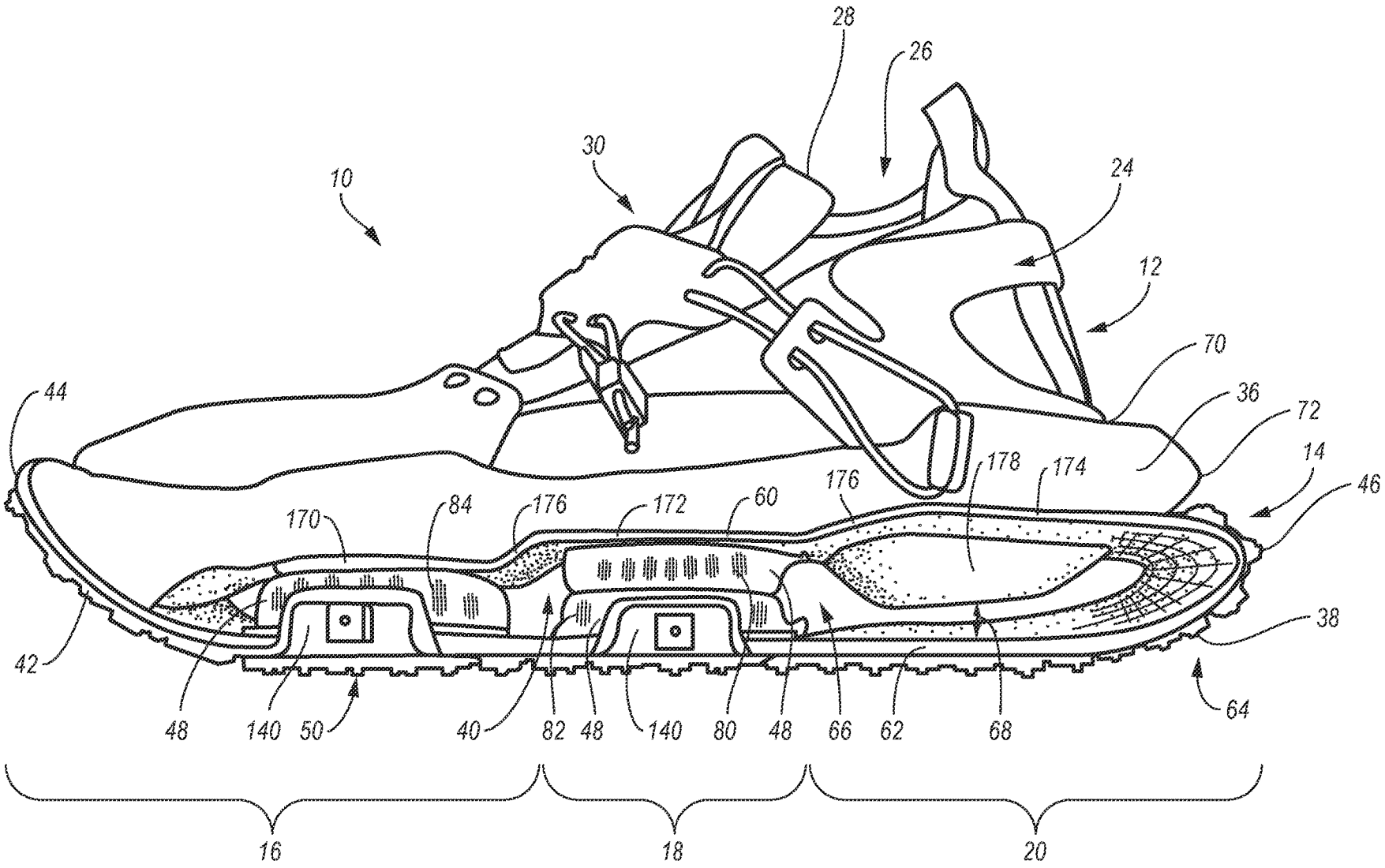
FIG. 1 is a side view of a lateral side of an article of footwear.
Figure 2:
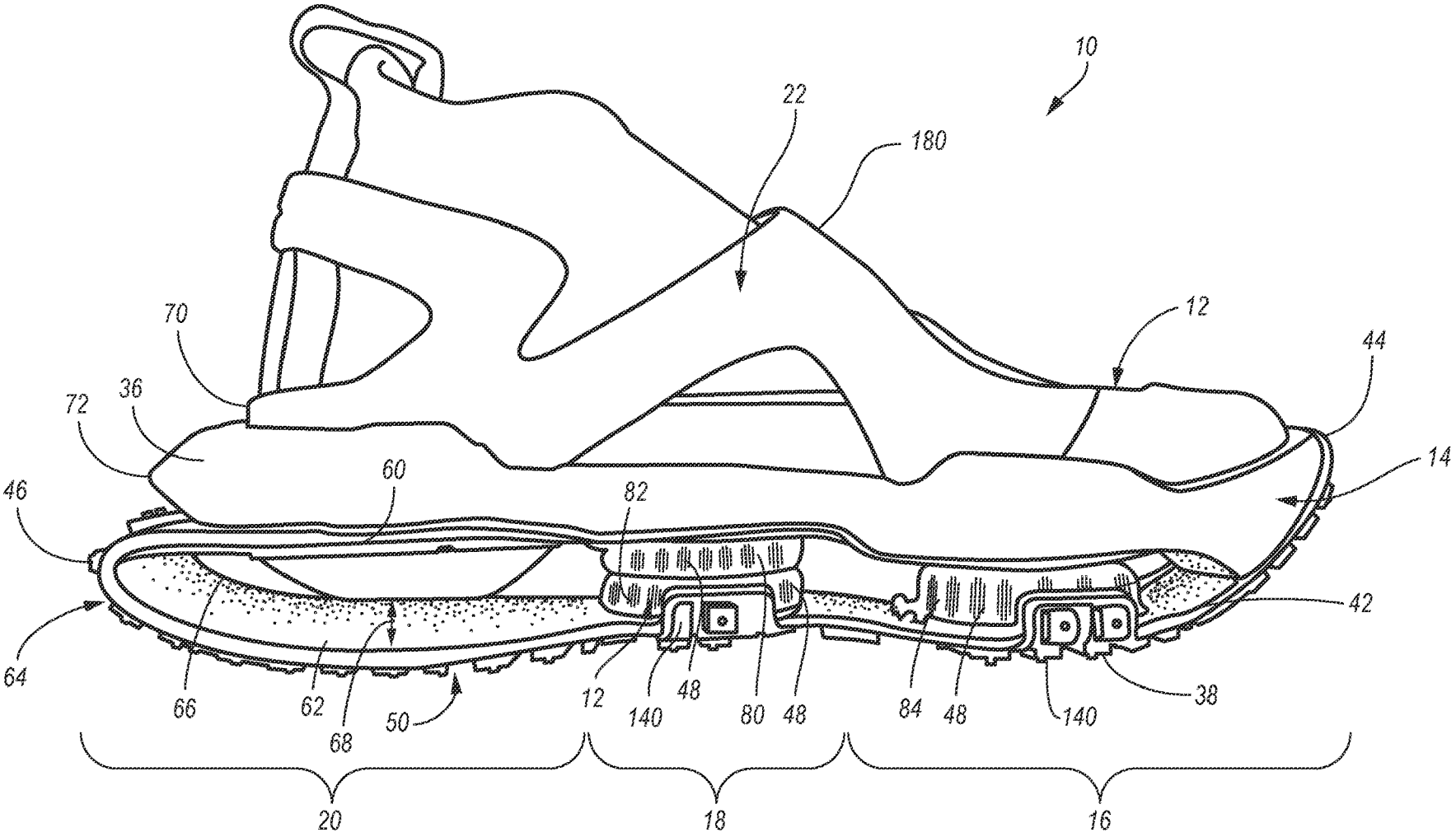
FIG. 2 is a side view of a medial side of an article of footwear.

With reference to FIGS. 1 and 2, an article of footwear 10 is depicted that includes an upper 12 and a sole structure 14 attached to the upper 12. The article of footwear 10 may be divided into one or more regions. The regions may include a forefoot region 16, a midfoot region 18, and a heel region 20. The forefoot region 16 may correspond with toes and joints connecting metatarsal bones with phalanx bones of a foot. The midfoot region 18 may correspond with an arch area of the foot while the heel region 18 may correspond with rear portions of the foot, including a calcaneus bone. The article of footwear 10 may additionally include a medial side 22 (shown in FIG. 2) and a lateral side 24 (shown in FIG. 1) that correspond with opposite sides of the article of footwear 10 and extend through the regions 16, 18, 20.

The upper 12 includes interior surfaces that defines an interior void 26 that receives and secures a foot for support on the sole structure 14. An ankle opening 28 in the heel region 20 may provide access to the interior void 26. For example, the ankle opening 28 may receive a foot to secure the foot within the void 26 and facilitate entry and removal of the foot from and to the interior void 26.

In some examples, one or more fasteners or other closure systems 30 extend across the upper 12 to adjust a fit of the interior void 26 around the foot while concurrently accommodating entry and removal of the foot therefrom. The fasteners or other closure systems 30 may include laces, straps, cords, latching mechanisms, clasps, snaps, hook-and-loop, or any other suitable type of fastener.

The upper 12 may be formed from one or more materials that are stitched or adhesively bonded together to form the interior void 26. Suitable materials of the upper 12 may include, textiles, foam, leather, and synthetic leather. The materials may be selected and located to impart properties of durability, air-permeability, wear-resistance, flexibility, and comfort to the foot while disposed within the interior void 26

The sole structure 14 is attached to an underside of the upper 12 and provides the article of footwear 10 with support and cushioning during use. Namely, the sole structure 14 attenuates ground reaction forces caused by the article of footwear 10 striking the ground during use. Accordingly, and as set forth below, the sole structure 14 may incorporate one or more materials having energy absorbing characteristics to allow the sole structure 14 to minimize the impact experienced by a user when wearing the article of footwear 10.

The sole structure 14 may include a midsole 36, an outsole 38, and one or more cushioning systems 40 disposed generally between the midsole 36 and the outsole 38. The cushioning system 40 may include a plate 42 that extends generally between an anterior end 44 of the article of footwear 10 and a posterior end 46, and one or more fluid-filled chambers 48. As will be described in greater detail below, the plate 42 and one or more fluid-filled chambers 48 may work in conjunction to further attenuate ground reaction forces.

With continued reference to FIGS. 1-2, the midsole 36 is shown as extending from the proximate the anterior end 44 of the article of footwear 10 to proximate the posterior end 46 and beyond the anterior and posterior extremes of the upper 12. The midsole 36 is secured to a lower portion of upper 12, and is positioned to extend under the foot during use. Among other purposes, midsole 36 attenuates ground reaction forces and absorbs energy (i.e., imparts cushioning) when walking or running, for example. The midsole 36 may be formed from an energy absorbing material such as, for example, polymer foam. Forming the midsole 36 from an energy-absorbing material, such as for example, an ethylvinylacetate foam allows the midsole 36 to attenuate ground-reaction forces caused by movement of the article of footwear 10 over ground during use.

An outsole 38 or outsole surface is provided on a lower, ground-facing surface of the cushioning system 40, and on an opposite side of the cushioning system 40 from the midsole 36 and upper 12. The outsole 38 may define a ground-engaging surface 50 that is operative to provide wear-resistance and to enhance traction between the article of footwear 12 and the ground. The outsole 38 may be formed from a resilient material such as, for example, rubber, which can improve traction and durability. The ground-engaging surface 50 may include one or more traction elements 52 that extend outward to provide the article of footwear 10 with increased traction during use.

Figure 3:
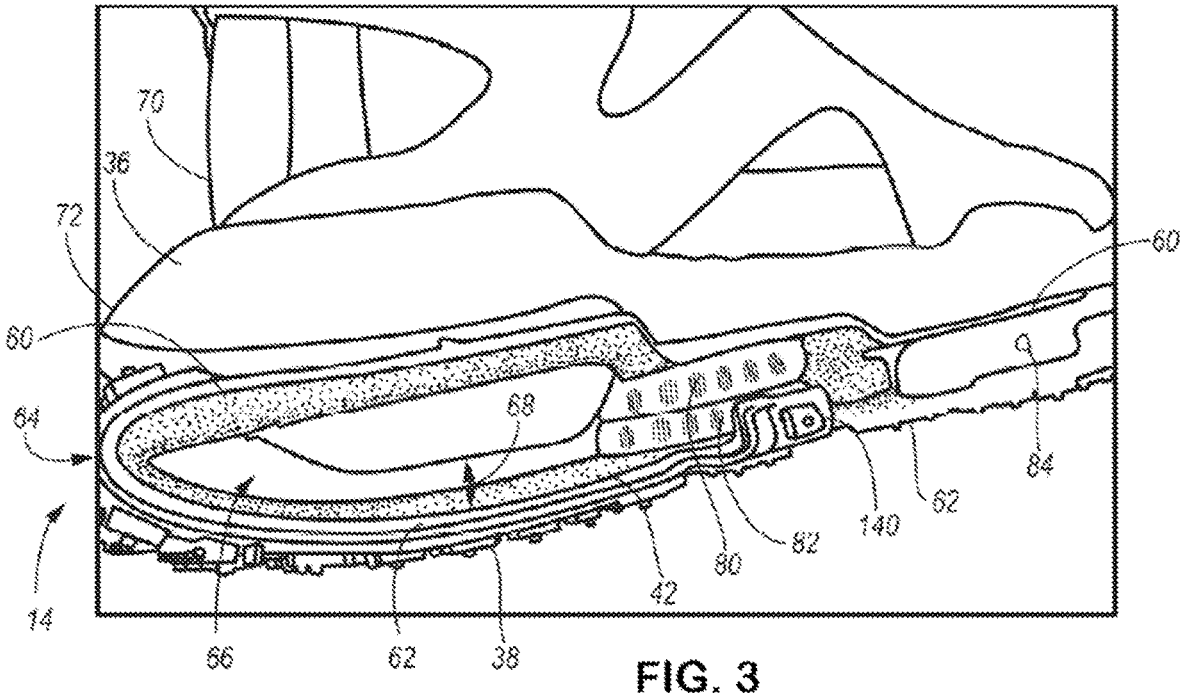
FIG. 3 is a side perspective view of the medial heel region of an article of footwear.
Figure 4:
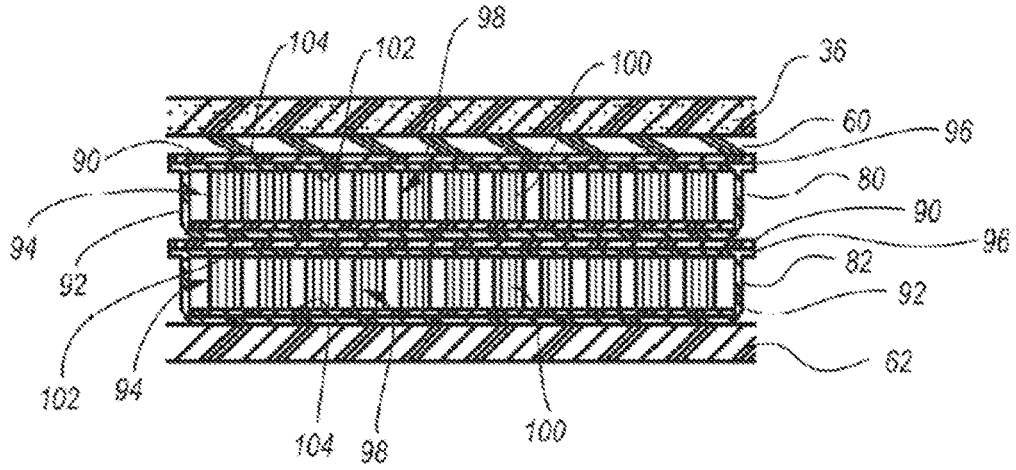
FIG. 4 is a schematic partial cross-sectional view of stacked, fluid-filled chambers with internal tensile elements.

As best shown in FIG. 3, the midsole 36 may serve to attach the cushioning system 40 to the upper 12. In one embodiment, the cushioning system 40 may be coupled to the midsole 36, for example, by adhering a portion of the plate 42 to a lower surface of the midsole 36 (i.e., via a suitable adhesive—not shown). Alternatively, the cushioning system 40 may be attached to the midsole 36 by molding a material of the midsole 36 directly to the plate 42. For example, the plate 42 may be disposed within a cavity of a mold (not shown) used to form the midsole 36. Accordingly, when the midsole 36 is formed (i.e. by foaming a polymer material), the material of the midsole 36 is joined to the material of the plate 42, thereby forming a unitary structure having both the midsole 36 and the plate 42.

While the cushioning system 40 is described and shown as being attached to an underside of the midsole 36 (i.e., on an opposite side of the midsole from the upper 12), a portion of the cushioning system 40 could alternatively be embedded within the material of the midsole 36. For example, a portion of the plate 42 may be encapsulated by the midsole 36 such that a portion of the midsole 36 extends through or to opposing sides of a portion of the plate 42. Further yet, the plate 42 could be disposed within the midsole 36 but not be fully encapsulated. For example, the plate 42 could be visible around a perimeter of the midsole 36 while a portion of the midsole 36 extends between the plate 42 and the upper 12 and another portion of the midsole 36 extends between the plate 42 and the outsole 38.

As illustrated, the plate 42 may include an upper plate 60 that is integrally coupled with a lower plate 62 (i.e., at a joint/joint region 64) to form a spring-like shock absorber. In a general sense, the upper plate 60 and lower plate 62 are both cantilevered from the joint region 64 and are configured to deflect toward each other in response to a static or dynamic load applied by the wearer. The cushioning system 40 may further include one or more fluid-filled chambers 48 provided between the upper plate 60 and the lower plate 62 to aid in controlling the deflection magnitude and rate apart from the joint 64.

In one configuration, the upper and lower plates 60, 62 may each extend along a longitudinal dimension of the sole structure 14, and in some embodiments one or both may fully extend from the anterior end 44 of the sole structure 14 to the posterior end 46 of the sole structure 14. In some configurations, the upper plate 60 may extend along at least a portion of the heel region 20 and midfoot region 18. In others, the upper plate 60 may extend across at least a portion of the heel region 20, midfoot region 18, and forefoot region 16. Additionally, in some configurations, the lower plate 62 may extend across at least a portion of the heel region 20, midfoot region 18, and forefoot region 16

In one configuration, the plate 42 may be formed from a single sheet of a relatively rigid material that is folded/wrapped back on itself. For example, the plate 42 may be formed from a non-foamed polymer material or, alternatively, from a composite material containing fibers such as carbon fibers. Suitable materials may include thermoplastic polyurethane (TPU), polyamides (e.g., PA6 or PA66), or other engineering polymers. The material may include a fiber fill, such as short or long fiber glass, aramid, bamboo, or carbon fibers, or may include similar continuous fabrics. Forming the plate 42 from a relatively rigid material allows the plate 42 to distribute forces associated with use of the article 10 while maintaining the upper plate 60 and lower plate 62 in a spaced relationship. In some embodiments, this spaced relationship is desirably greater than about 5 mm, or greater than about 8 mm, or even greater than about 10 mm.

In one configuration, the joint region 64 of the plate 42 may be provided within, or posterior to the heel region 20 of the sole structure 14, and may be formed with a suitable thickness and stiffness to withstand expected static and impact loads without permitting the upper and lower plates 60, 62 to overly deflect and/or come into contact with each other. In such an embodiment, an intermediate recess/void 66 may exist between the upper and lower plates 60, 62 within the heel region 20. In an unloaded/relaxed state, this recess/void 66 may have a first height 68, measured normal to the ground. When worn, static and impact loads from the wearer may urge the upper and lower plates 60, 62 into a more closely spaced relationship. Said another way, the recess/void 66 may be compressed to have a second height that is less than the first height 68.

In one configuration, the degree to which the plates 60, 62 are flex toward each other in the heel region 20 is largely controlled by the stiffness and location of the plate 42 within the joint region 64. While some elastic flexure/movement of the upper and lower plates 60, 62 is desirable to provide cushioning/force attenuation, if the joint region 64 is not sufficiently stiff, the deflection could be larger than desired, which could cause the shoe to feel unstable.

In some embodiments, so that the entire heel region 20 experiences similar reaction forces from the cushioning system, the joint region 64 of the plate 42 may be provided rearward of the posterior end 70 of the upper 12 and/or rearward of a posterior end 72 of the midsole 36.

While the cushioning response within the heel region 20 may largely be attributable to the elasticity/stiffness of the joint region 64 of the plate 42, the cushioning system 40 may rely on one or more fluid-filled chambers 48 to provide the cushioning response within the midfoot region 18 and/or within the forefoot region 16. In the embodiment shown in FIGS. 1-3, the cushioning system 40 includes a first fluid-filled chamber 80 and a second fluid-filled chamber 82 provided within the midfoot region 18, and a fluid-filled chamber 84 provided in the forefoot region 16.

As illustrated in FIGS. 1-4, the first fluid-filled chamber 80 is disposed generally between the upper plate 60 and the second fluid-filled chamber 82 while the second fluid-filled chamber 82 is disposed between the lower plate 62 and the first fluid-filled chamber 80. Specifically, the first fluid-filled chamber 80 is attached to a lower surface of the upper plate 60 at a first side and is attached to the second fluid-filled chamber 82 at a second side. The second fluid-filled chamber 82 is attached at a first side to the upper surface of the lower plate 62 and is attached to the first fluid-filled chamber 80 at a second side. Additionally or alternatively, the first fluid-filled chamber 80 may be attached to the second fluid-filled chamber 82 by melting the material of the first fluid-filled chamber 80 and the material of the second fluid-filled chamber 82 at a junction of the first fluid-filled chamber 80 and the second fluid-filled chamber 82 (e.g., similar to welding).

Similar to the first and second fluid-filled chambers 80, 82, the forefoot fluid-filled chamber 84 may be provided between the upper plate 60 and the lower plate 62. In one embodiment, the forefoot fluid-filled chamber 84 is attached to a lower surface of the upper plate 60 at a first side and is attached to the upper surface of the lower plate 62 at a second side. The fluid-filled chambers 80, 82, 84 may be attached to one another and/or to the upper and lower plates 60, 62, respectively, via a suitable adhesive.

Figure 5:
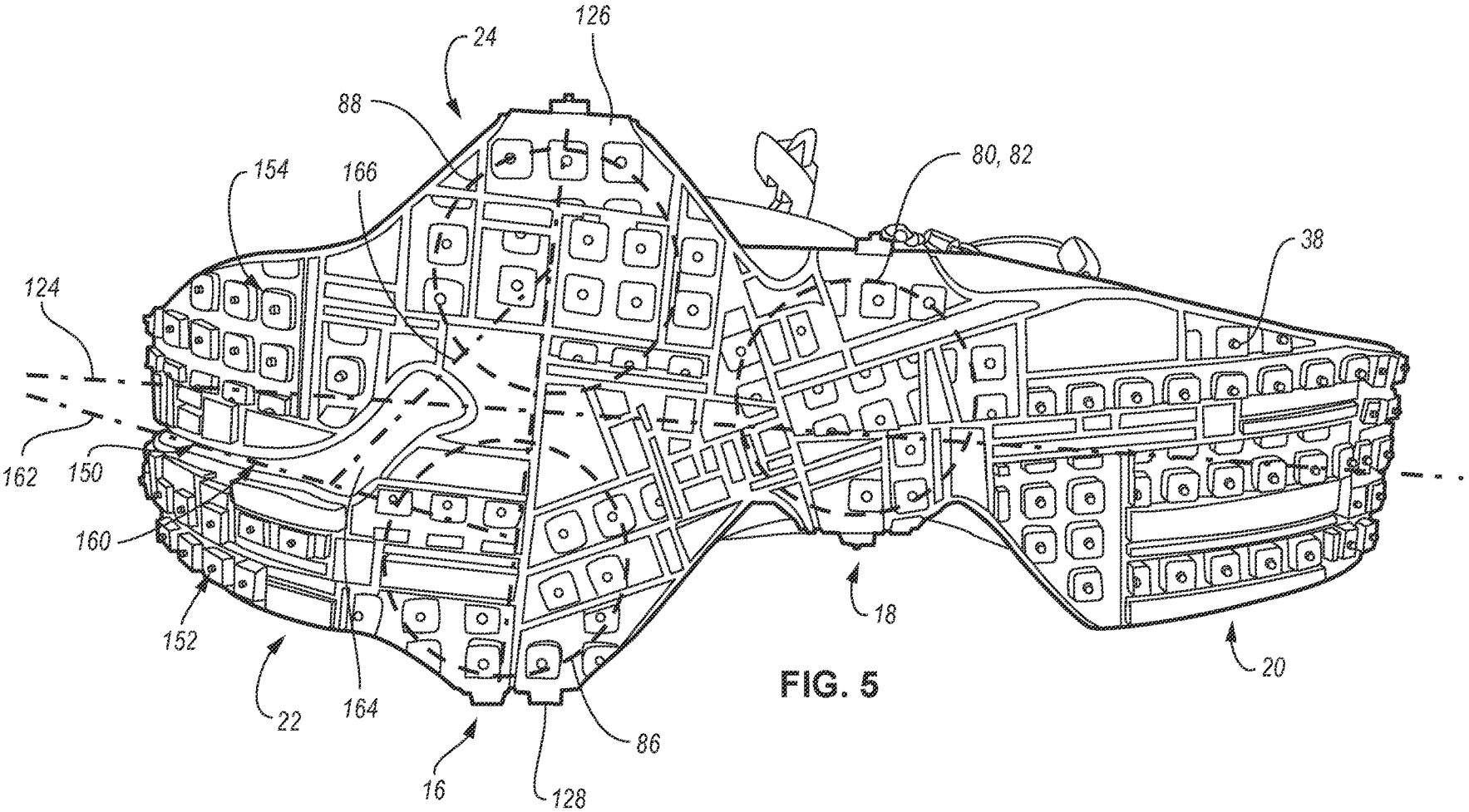
FIG. 5 is a bottom view of a sole structure for an article of footwear.

In one configuration, such as best shown in FIG. 5, the forefoot fluid chamber 84 may actually comprise two discrete fluid filled chambers: a medial forefoot fluid-filled chamber 86 and lateral forefoot fluid-filled chamber 88. In this embodiment, the midfoot region 18 may include two stacked fluid-filled chambers 80, 82, while the forefoot region 16 may include two laterally adjacent fluid-filled chamber 86, 88.

Referring again to FIG. 4, each of the fluid-filled chambers 80, 82, 84, 86, 88 may include a first barrier element 90 and a second barrier element 92. The first barrier element 90 and the second barrier element 92 may be formed from a sheet of thermoplastic polyurethane (TPU). Specifically, the first barrier element 90 may be formed from a sheet of TPU material and may include a substantially planar shape. The second barrier element 92 may likewise be formed from a sheet of TPU material and may be formed into the configuration shown in FIG. 4 to define an interior void 94. The first barrier element 90 may be joined to the second barrier element 92 by applying heat and pressure at a perimeter of the first barrier element 90 and the second barrier element 92 to define a peripheral seam 96. The peripheral seam 96 seals the internal interior void 94, thereby defining a volume of the respective chambers 80, 82, 84, 86, 88.

The interior void 94 of the fluid-filled chambers 80, 82, 84, 86, 88 may receive a tensile element 98 therein. Each tensile element 98 may include a series of tensile strands 100 extending between an upper tensile sheet 102 and a lower tensile sheet 104. The upper tensile sheet 102 may be attached to the first barrier element 90 while the lower tensile sheet 104 may be attached to the second barrier element 92. In this manner, when each chamber 80, 82, 84, 86, 88 receives a pressurized fluid, the tensile strands 100 of the tensile elements 98 are placed in tension. Because the upper tensile sheet 102 is attached to the first barrier element 90 and the lower tensile sheet 104 is attached to the second barrier element 92, the tensile strands 100 retain a desired shape of the respective chambers 80, 82, 84, 86, 88 when the pressurized fluid is injected into the interior void 94.

During operation, when the ground-engaging surface 50 of the outsole 38 contacts the ground, a force is transmitted via the lower plate 62 to the fluid-filled chambers 80, 82, 84, 86, 88. The applied force causes the individual fluid-filled chambers 80, 82, 84, 86, 88 to compress, thereby absorbing the forces associated with the outsole 38 contacting the ground. The force is transmitted to the upper plate 60 and midsole 36 but is not experienced by the user as a point or localized load. Instead, the forces applied through the outsole 38 are dissipated along a length of the plates 60, 62 due to the rigidity of the plates 60, 62.

Figure 6:
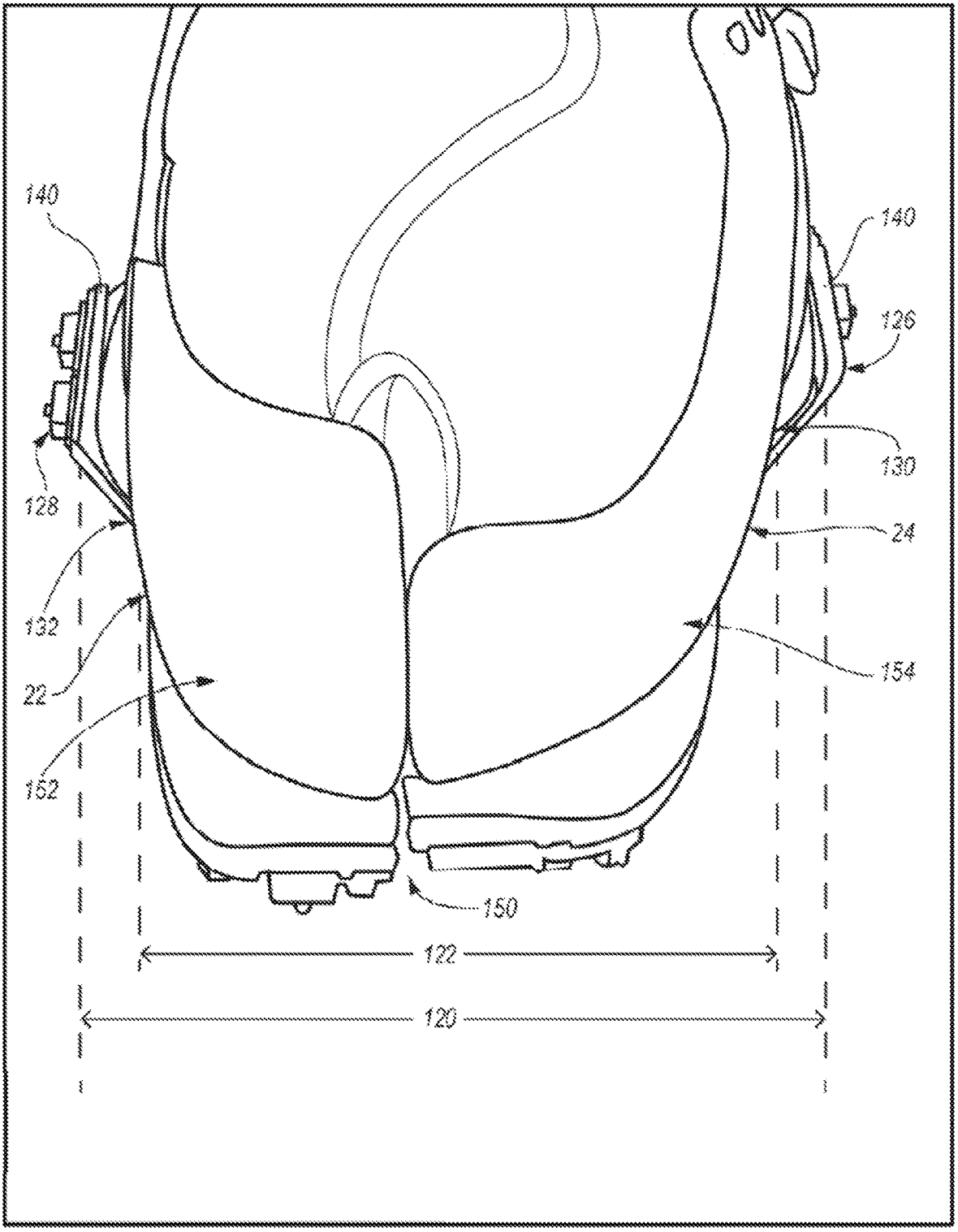
FIG. 6 is a top perspective view of the forefoot region of an article of footwear.

Referring to FIG. 6, in one configuration the forefoot region 16 of the sole structure 14 may have a lateral width 120 that is greater than a corresponding lateral width 122 of the upper 12 measured at the same position along the longitudinal axis 124. The lateral width 120 of the sole structure 14 may be measured between the lateral edge 126 and the medial edge 128 of the sole structure 14 and orthogonal to the primary longitudinal axis 124 (best shown in FIG. 5). Similarly, the lateral width 122 of the upper 12 may be measured between the lateral edge 130 and the medial edge 132 of the upper 12 and orthogonal to the primary longitudinal axis 124.

As generally illustrated in FIG. 6, in one configuration, the medial forefoot fluid-filled chamber 86 may at least partially extend beyond the medial edge 132 of the upper 12 and lateral forefoot fluid-filled chamber 88 may at least partially extend beyond the lateral edge 130 of the upper 12 (when viewed from a top view). Doing so may provide the footwear with additional lateral stability and more even pressure distribution between the outsole 38 and the ground.

In some configurations, the lower plate 62 may include one or more up-turned sole portions 140 that extend, for example, on a medial side of the medial forefoot fluid-filled chamber 86, on a lateral side of the lateral forefoot fluid-filled chamber 88, and on one or both of the medial side or lateral side of the second midfoot fluid-filled chamber 82. Such a configuration may provide some measure of impact protection to the fluid-filled chambers. Likewise, if the outsole 38 extends upward onto an outer surface of this up-turned sole portion 140, then the feature may further provide traction capabilities to the sidewall of the sole structure 14.

While the lower plate 62 may extend from an extreme anterior end to an extreme posterior end of the sole structure, in one configuration, the upper plate 60 may terminate immediately forward/anterior of the forefoot fluid-filled chambers 84. In this embodiment, the midsole 36 may be affixed to both an upper surface of the upper plate 60 and an upper surface of the lower plate 62.

Referring to FIGS. 5-6, in one configuration, the forefoot region 16 may include a split 150 that extends from an anterior end of the article 10. In doing so, some or all of the forefoot region 16 may be divided into a medial forefoot toe region 152, and a lateral forefoot toe region 154. When worn, the split 150 may extend between two immediately adjacent ones of the wearer's toes. Such a design takes advantage of the independent medial and lateral fluid-filled chambers 86, 88 since the medial and lateral forefoot toe regions 152, 154 are physically separate. To provide further independence the split 150 may extend through and divide the upper 12, midsole 36, and lower plate 62. In some embodiments, the upper plate 60 may further be divided such that the split extends at least partially between the medial and lateral fluid-filled chambers 86, 88. Referring to FIG. 5, in one configuration, the split 150 in the lower plate 62 may include two segments, a forward segment 160 provided substantially along a first split axis 162, and a second, rearward segment 164 provided along a second split axis 166. In one configuration, the first split axis 162 may intersect the medial fluid-filled chamber 86, whereas the second split axis 166 may intersect the lateral fluid-filled chamber 88. Furthermore, both axes 162, 166 may be provided at angles relative to the longitudinal axis 124 of the sole 14. For example, the first split axis 162 may extend from the anterior end 44 of the sole structure 14 generally toward the medial edge 128. Conversely, the second split axis 166 may extend from the first split axis 162 toward the lateral edge 126 of the sole structure 14. Doing so may provide a further degree of independent movement between the medial and lateral sides of the forefoot, and in particular to the medial and lateral forefoot toe regions 152, 154

Looking at the arrangement of the forefoot fluid-filled chambers 86, 88 themselves, in one configuration, the medial fluid-filled chamber 86 may be slightly forward of the lateral fluid-filled chamber 88, such that a line 168 drawn between their respective centers is provided at a slight angle relative to the longitudinal axis 124.

Referring again to FIG. 1, in one configuration, the lower plate 62 may be a generally smooth and continuous plate (when viewed from the side view), with up-turned arcuate anterior and posterior end portions. Conversely, the upper plate 60 may include a stepped geometry that is defined by a first, forefoot portion 170, a second, midfoot portion 172, and a third heel portion 174. The forefoot portion 170 may be the closest to the lower plate 62, the heel portion 174 may be located the farthest distance from the lower plate 62, and the midfoot portion 172 may be located an intermediate distance that is between that of the forefoot and heel portions 170, 174. Angled transition zones 176 may exist between adjacent forefoot and midfoot portions 170, 172, and between adjacent midfoot and heel portions 172, 174. Using the stepped approach may allow the cushioning system 40 to accommodate the stacked fluid-filled cushioning chambers in the midfoot region 18.

In some embodiments, the heel region 20 may further include a bumper 178 disposed between the upper and lower plates 60, 62. In one configuration, the bumper 178 may be adhered to a lower surface of the upper plate 60, and may have a height that permits a spaced relationship between the bumper 178 and the lower plate 62. In another embodiment, the bumper 178 may be a portion of the midsole 36 that extends through a hole in the upper plate 60. In still another embodiment, the bumper 178 may be a molded-in contour of the upper plate 60. The purpose of the bumper 178 may be to stage the allowable deflection response of the heel region 20, while also preventing larger objects from becoming trapped within the cushioning system 40.

Figure 7:
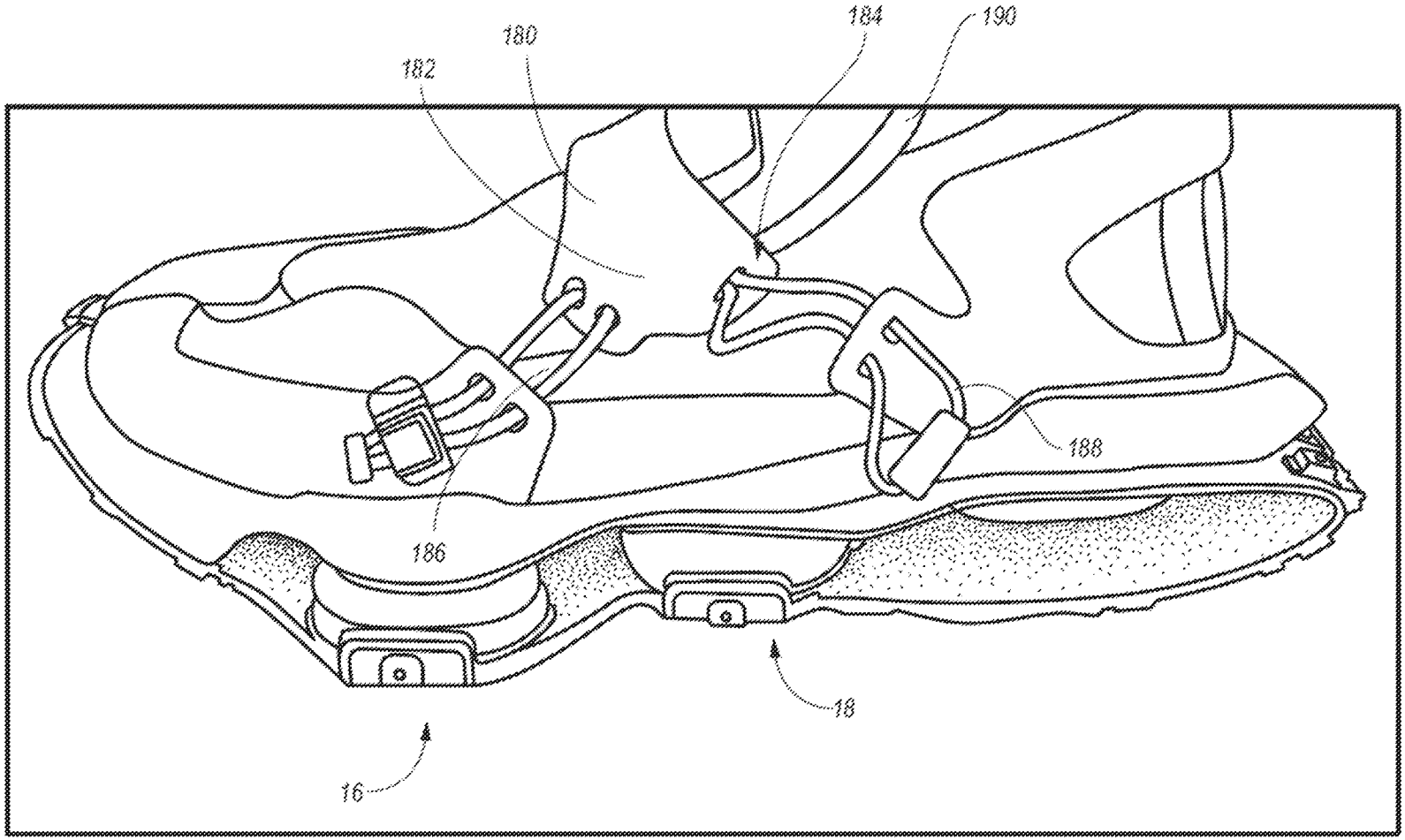
FIG. 7 is a top side view of an article of footwear including a dual tie down closure system.

In one configuration, the closure system 30 of the upper 12 may include one or more over-arch straps 180 that extend from the medial side 22 of the shoe, such as shown in FIG. 2 over the upper 12 and across to the lateral side 24, such as shown in FIG. 7. On the lateral end 182 of the strap 180, the closure system may include a dual fastening system 184. This dual fastening system 184 may include a first fastener 186 that secures and draws the strap 180 toward the forefoot region 16 of the sole structure 14. Additionally, the dual fastening system 184 may include a second fastener 188 that secures and draws the strap 180 toward the heel region 20 of the sole structure 14.

Figure 8:
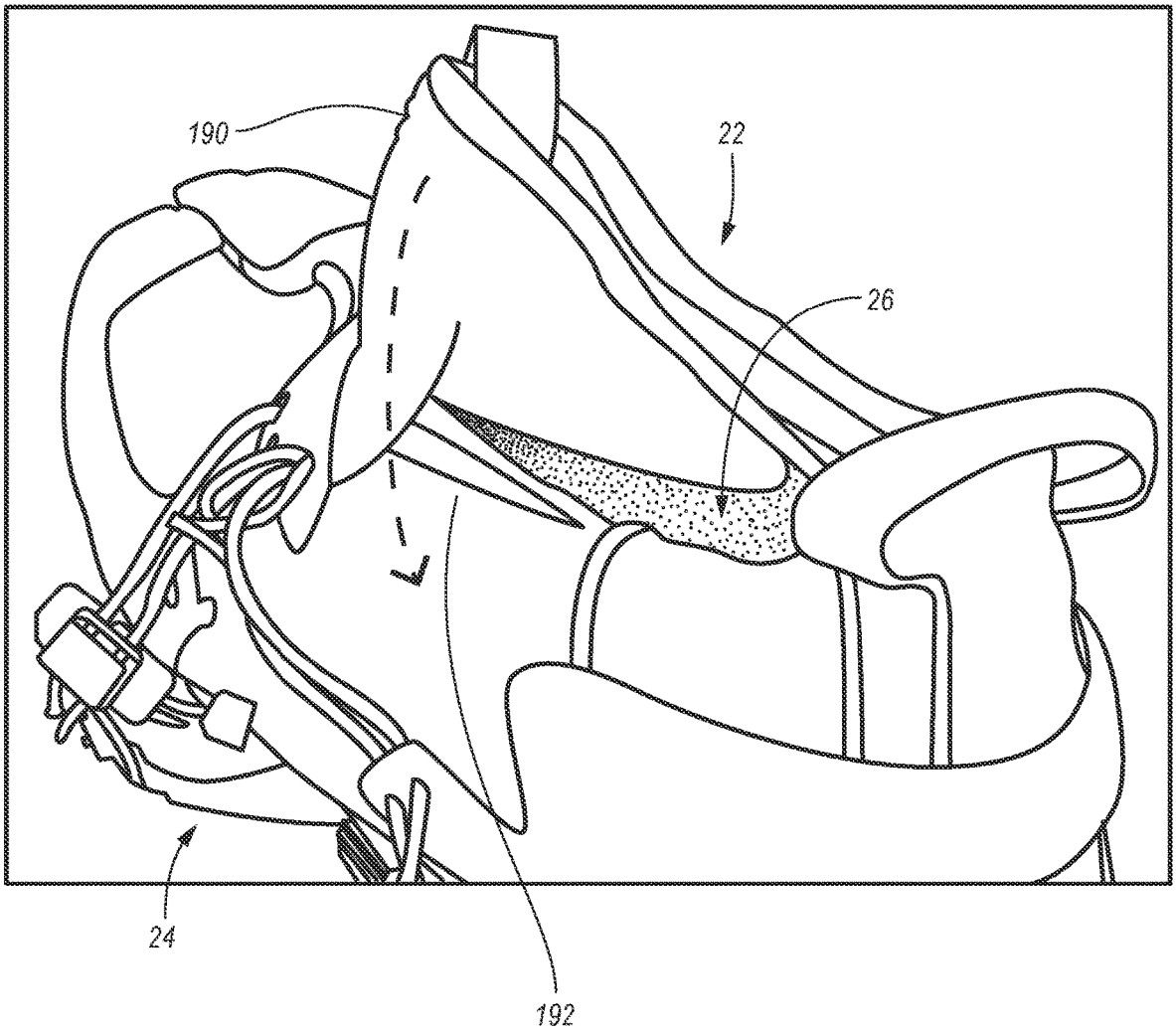
FIG. 8 is a top lateral perspective view of the throat of an article of footwear.

The closure system 30 may further include a wrap-over tongue 190, such as shown in FIG. 8, that extends from a medial side 22 of the upper 12 toward a lateral side 24 of the upper 12. When the over-arch strap 180 is drawn closed and secured, it may hold the tongue 190 in close, overlapping contact with a lateral wall 192 of the upper 12.

To manufacture the cushioning system, in one configuration, the plate 42 may begin as a die-cut or injection-molded sheet. If the base resin of the plate 42 is a thermoplastic polymer, the sheet may be heated and bent around a mold that has the contours of the upper plate 60, lower plate 62, and joint 64. Once the plate 42 is formed about this tool the up-turned sole portions 140 may then be formed via localized heating and forming. In an alternative embodiment, the plate may be injection molded into its finished form. In some embodiments, the outsole 38 may be integral to the lower plate 62, such as by being insert molded or co-molded with the plate 42. In another embodiment, the outsole 38 may be adhered to the lower plate 62, for example, via a suitable adhesive.

The above features and advantages, and other features and advantages, of the present teachings are readily apparent from the following detailed description of some of the best modes and other embodiments for carrying out the present teachings, as defined in the appended claims, when taken in connection with the accompanying drawings.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range. Each value within a range and the endpoints of a range are hereby all disclosed as separate embodiment. The terms "comprises," "comprising," "including," and "having," are inclusive and therefore specify the presence of stated items, but do not preclude the presence of other items. As used in this specification, the term "or" includes any and all combinations of one or more of the listed items. When the terms first, second, third, etc. are used to differentiate various items from each other, these designations are merely for convenience and do not limit the items.

Any directional references used herein presume that the article of footwear is positioned in an upright posture on a flat, horizontal ground plane, such that the outsole is in contact with the ground plane (i.e., as if worn by a user standing in an upright manner)

The invention claimed is:

1. An article of footwear having a heel region, a midfoot region, and a forefoot region, the article of footwear comprising:

an upper having an internal volume adapted to receive a foot of a wearer;

a sole structure secured to an underside of the upper, the sole structure including:

a midsole formed from a polymeric foam material;

a ground contacting outsole surface; and a cushioning system disposed between the midsole and the ground contacting outsole surface, the cushioning system including:

a non-foamed polymeric plate that has a cantilever fold at a posterior end and extends through a joint region to form an integrally connected upper plate and a lower plate that are provided in a transversely spaced relationship, wherein the joint region is provided within or posterior to the heel region, and wherein each of the upper plate and the lower plate extend from the joint region across a portion of the heel region, the midfoot region and the forefoot region; and at least one of:

a midfoot fluid-filled chamber provided between the upper plate and the lower plate within the midfoot region, the midfoot fluid-filled chamber comprising at least a first polymeric barrier fused with a second polymeric barrier to define a internal void therebetween, and wherein the midfoot fluid-filled chamber is adhered to at least one of the upper plate and the lower plate; or a forefoot fluid-filled chamber provided between the upper plate and the lower plate within the forefoot region, the forefoot fluid-filled chamber comprising at least a first polymeric barrier fused with a second polymeric barrier to define a internal void therebetween, and wherein the forefoot fluid-filled chamber is adhered to at least one of the upper plate and the lower plate.

2. The article of footwear of claim 1, wherein the midsole has a first hardness, the plate has a second hardness, and wherein the second hardness is greater than the first hardness.

3. The article of footwear of claim 1, wherein the at least one of the midfoot fluid-filled chamber or the forefoot fluid-filled chamber includes a first midfoot fluid-filled chamber and a second midfoot fluid-filled chamber provided between the upper plate and the lower plate within the midfoot region, the second midfoot fluid-filled chamber comprising at least a first polymeric barrier fused with a second polymeric barrier to define a internal void therebetween;

the first midfoot fluid-filled chamber in contact with and adhered to the upper plate; and the second midfoot fluid-filled chamber in contact with and adhered to the lower plate; and wherein the first midfoot fluid-filled chamber and the second midfoot fluid-filled chamber are in a stacked arrangement such that the first midfoot fluid-filled chamber is positioned between the upper plate and the second midfoot fluid-filled chamber, and the second midfoot fluid-filled chamber is positioned between the first midfoot fluid-filled chamber and the lower plate.

4. The article of footwear of claim 3, wherein the at least one of the first midfoot fluid-filled chamber or the second midfoot fluid-filled chamber comprises a plurality of tensile elements extending across the internal void of the chamber from the first polymeric barrier to the second polymeric barrier.

5. The article of footwear of claim 1, wherein the at least one of the midfoot fluid-filled chamber or the forefoot fluid-filled chamber includes a lateral forefoot fluid-filled chamber and a medial forefoot fluid-filled chamber provided between the upper plate and the lower plate within the forefoot region, the medial forefoot fluid-filled chamber comprising at least a first polymeric barrier fused with a second polymeric barrier to define a internal void therebetween, the lateral forefoot fluid-filled chamber and the medial forefoot fluid-filled chamber being arranged in a laterally adjacent manner such that:

the lateral forefoot fluid-filled chamber is positioned between a lateral edge of the sole structure and the medial forefoot fluid-filled chamber; and the medial forefoot fluid-filled chamber is positioned between a medial edge of the sole structure and the lateral forefoot fluid-filled chamber.

6. The article of footwear of claim 5, wherein at least one of the lateral forefoot fluid-filled chamber or the medial forefoot fluid-filled chamber comprises a plurality of tensile elements extending across an internal void of the chamber from the first polymeric barrier to the second polymeric barrier.

7. The article of footwear of claim 1, further comprising a split extending from an anterior edge of the forefoot region and separating a portion of each of the upper, the midsole, and the lower plate into a medial forefoot toe portion and a lateral forefoot toe portion.

8. A sole structure for an article of footwear having a heel region, a midfoot region, and a forefoot region, the sole structure comprising:

a midsole formed from a polymeric foam material;

a ground contacting outsole surface; and a cushioning system disposed between the midsole and the ground contacting outsole surface, the cushioning system including:

a non-foamed polymeric plate that has a cantilever fold at a posterior end and extends through a joint region to form an integrally connected upper plate and a lower plate that are provided in a transversely spaced relationship, wherein the joint region is provided within or posterior to the heel region, and wherein each of the upper plate and the lower plate extend from the joint region across a portion of the heel region, the midfoot region and the forefoot region; and at least one of:

a midfoot fluid-filled chamber provided between the upper plate and the lower plate within the midfoot region, the midfoot fluid-filled chamber comprising at least a first polymeric barrier fused with a second polymeric barrier to define a internal void therebetween, and wherein the midfoot fluid-filled chamber is adhered to at least one of the upper plate and the lower plate; or a forefoot fluid-filled chamber provided between the upper plate and the lower plate within the forefoot region, the forefoot fluid-filled chamber comprising at least a first polymeric barrier fused with a second polymeric barrier to define a internal void therebetween, and wherein the forefoot fluid-filled chamber is adhered to at least one of the upper plate and the lower plate.

9. The sole structure of claim 8, wherein the midsole has a first hardness, the plate has a second hardness, and wherein the second hardness is greater than the first hardness.

10. The sole structure of claim 8, wherein the at least one of the midfoot fluid-filled chamber or the forefoot fluid-filled chamber includes a first midfoot fluid-filled chamber and a second midfoot fluid-filled chamber provided between the upper plate and the lower plate within the midfoot region, the second midfoot fluid-filled chamber comprising at least a first polymeric barrier fused with a second polymeric barrier to define a internal void therebetween;

the first midfoot fluid-filled chamber in contact with and adhered to the upper plate; and the second midfoot fluid-filled chamber in contact with and adhered to the lower plate; and wherein the first midfoot fluid-filled chamber and the second midfoot fluid-filled chamber are in a stacked arrangement such that the first midfoot fluid-filled chamber is positioned between the upper plate and the second midfoot fluid-filled chamber, and the second midfoot fluid-filled chamber is positioned between the first midfoot fluid-filled chamber and the lower plate.

11. The sole structure of claim 10, wherein at least one of the first midfoot fluid-filled chamber or the second midfoot fluid-filled chamber comprises a plurality of tensile elements extending across an internal void of the chamber from the first polymeric barrier to the second polymeric barrier.

12. The sole structure of claim 8, wherein the at least one of the midfoot fluid-filled chamber or the forefoot fluid-filled chamber includes a lateral forefoot fluid-filled chamber and a medial forefoot fluid-filled chamber provided between the upper plate and the lower plate within the forefoot region, the medial forefoot fluid-filled chamber comprising at least a first polymeric barrier fused with a second polymeric barrier to define a internal void therebetween, the lateral forefoot fluid-filled chamber and the medial forefoot fluid-filled chamber being arranged in a laterally adjacent manner such that:

the lateral forefoot fluid-filled chamber is positioned between a lateral edge of the sole structure and the medial forefoot fluid-filled chamber; and the medial forefoot fluid-filled chamber is positioned between a medial edge of the sole structure and the lateral forefoot fluid-filled chamber.

13. The sole structure of claim 12, wherein at least one of the lateral forefoot fluid-filled chamber or the medial forefoot fluid-filled chamber comprises a plurality of tensile elements extending across an internal void of the chamber from the first polymeric barrier to the second polymeric barrier.

* * * * *